9/2/80 OR 4,220,892

United States Patent [19]

van Raalte

[11] 4,220,892

[45] Sep. 2, 1980

[54] PHOSPHOR SCREEN FOR MODULAR FLAT PANEL DISPLAY DEVICE

[75] Inventor: John A. van Raalte, Princeton, N.J.

[73] Assignee: RCA Corporation, New York, N.Y.

[21] Appl. No.: 806,282

[22] Filed: Jun. 13, 1977

[51] Int. Cl.[2] ..... H01J 29/32; H01J 31/20

[52] U.S. Cl. ..... 313/422; 313/470

[58] Field of Search ..... 313/470, 471, 472, 422

[56] References Cited

U.S. PATENT DOCUMENTS

| | | | |
|---|---|---|---|
| 2,802,964 | 8/1957 | Jesty | 313/472 |
| 3,614,504 | 10/1971 | Kaplan | 313/472 |
| 3,904,923 | 9/1975 | Schwartz | 313/103 X |
| 4,028,582 | 6/1977 | Anderson et al. | 313/422 |
| 4,145,633 | 3/1979 | Peters et al. | 313/422 |

FOREIGN PATENT DOCUMENTS 960940 6/1964 United Kingdom .

*Primary Examiner*—Robert Segel

*Attorney, Agent, or Firm*—Eugene M. Whitacre; Donald S. Cohen; Vincent J. Coughlin, Jr.

[57] ABSTRACT

Across the screen is a mosaic of spaced phosphor bodies which emit light of different colors when excited by electrons. Phosphors which emit three different colors, e.g. red, green and blue, are used and are disposed in a regular repetitive array of groups of three, i.e. triads. In every other triad the phosphor body which emits the color which has the least acuity to the eye, e.g. blue, is replaced by a nonluminescent black material. The blue phosphor bodies are of a width substantially equal to the width of the penumbra of the electron beam which impinges on the blue phosphor bodies. The red and green emitting phosphor bodies are of a width substantially equal to the umbra of their corresponding electron beams which is about one-half the penumbra of the beams. The phosphor bodies are spaced apart such that the portions of the red and green impinging electron beams which do not impinge on their respective phosphor bodies impinge on nonluminescent spaces between the phosphor bodies and the center-to-center distances between adjacent phosphor bodies of like color are equal across the screen.

11 Claims, 2 Drawing Figures

PHOSPHOR SCREEN FOR MODULAR FLAT PANEL DISPLAY DEVICE

BACKGROUND OF THE INVENTION

The present invention relates to a flat panel display having internal envelope support walls, and particularly to a color phosphor screen therefor.

There has been developed a flat panel display which includes an evacuated envelope having spaced, parallel, substantially flat front and back walls and a plurality of spaced, substantially parallel support walls extending between and substantially perpendicular to the front and back walls. One function of the support walls is to provide internal support for the front and back walls against the external atmospheric pressure. On the inner surface of the front wall is a phosphor screen and the display includes means for generating electrons and directing beams of the electrons against the phosphor screen to achieve a visual display. One type of such a flat panel display is shown and described in the copending application for Letters Patent of T. O. Stanley, Ser. No. 607,492, filed Aug. 25, 1975, entitled "Flat Electron Beam Addressed Device", now U.S. pat. No. 4,031,427, issued June 21, 1977 and C. H. Anderson et al, Ser. No. 615,353, filed Sept. 22, 1975, entitled "Guided Beam Flat Display Device", now U.S. Pat. No. 4,028,582, issued June 7, 1977.

In general, a phosphor screen for a color display includes bodies of phosphors which when excited by electrons emit light of different colors, e.g., red, green and blue, arranged across the screen in repetitive triads. The bodies may be circular or other shaped areas of the phosphors or parallel stripes of the phosphors. A problem in using such a screen in a display device of the above-described construction is that the contact between the support walls and the front wall provide interruptions in the phosphor screen which can interfere with the visual display, e.g. provide undesirable visible lines across the display.

The concurrently filed application of Letters Patent of T. O. Stanley, entitled "Phosphor Screen For Flat Panel Color Display", Ser. No. 806,281 filed June 13, 1977 describes a color phosphor screen having bodies of a nonluminous black material which hide the contact areas between the support walls and the front wall. The black material bodies are inserted in place of certain of the blue emitting phosphor bodies in the phosphor screen pattern. Although this eliminates some of the blue emitting phosphor bodies it does not appear to the eye to interrupt the appearance of the visual display provided by the screen because of the low acuity of the eye in the blue part of the spectrum.

Although this type of phosphor screen will hide the edges of the support walls without providing to the eye any interruptions in the appearance of the visual display provided by the screen, it has problems with regard to its being used in certain types of flat panel displays, such as the modular flat panel display described in the previously referred to copending application of C. H. Anderson et al, Ser. No. 615,353, now U.S. Pat. No. 4,028,582, issued June 7, 1977. In this type of phosphor screen the blue emitting phosphor bodies which remain must provide proportionately higher blue emission to provide for color balance because some of the blue emitting phosphor bodies are missing. This requires either a higher intensity electron beam for the blue phosphor bodies or more than one electron beam for each blue phosphor body. However, in the modular flat panel display device three electron beams of substantially uniform and limited intensity are provided in each channel between the support walls with each beam scanning the phosphor bodies of a separate color. Thus, for the blue beam to have roughly twice the intensity of the other beams, it may be necessary to reduce the intensity of the red and green beams by a factor of two, thereby also reducing the brightness range of the display to one-half of its original value. Also, in the phosphor screen it is necessary to provide uniform center to center spacing between the phosphor bodies of like color to achieve color balance.

SUMMARY OF THE INVENTION

The present invention relates to a phosphor screen for a flat display device of the type which includes an evacuated envelope having a plurality of spaced, support walls extending to a phosphor screen bearing wall of the envelope and means for generating at least one beam of electrons and directing the beam across the phosphor screen. The phosphor screen includes repetitive groups of spaced different color emitting phosphor bodies. A selected one of the same color emitting bodies in some of the groups is replaced by a body of nonluminous material. Each of the one color emitting bodies which is remaining is of a width substantially equal to the width of the electron beam which impinges on the one color emitting body. Each of the other color emitting phosphor bodies is of a width less than the width of the electron beam which impinges on these bodies. The combined width of each of the other color emitting bodies and the nonluminous spaces on each side of each of the other two emitting bodies is substantially equal to the width of the electron beam which impinges on each of these bodies.

DETAILED DESCRIPTION

Figure 1:
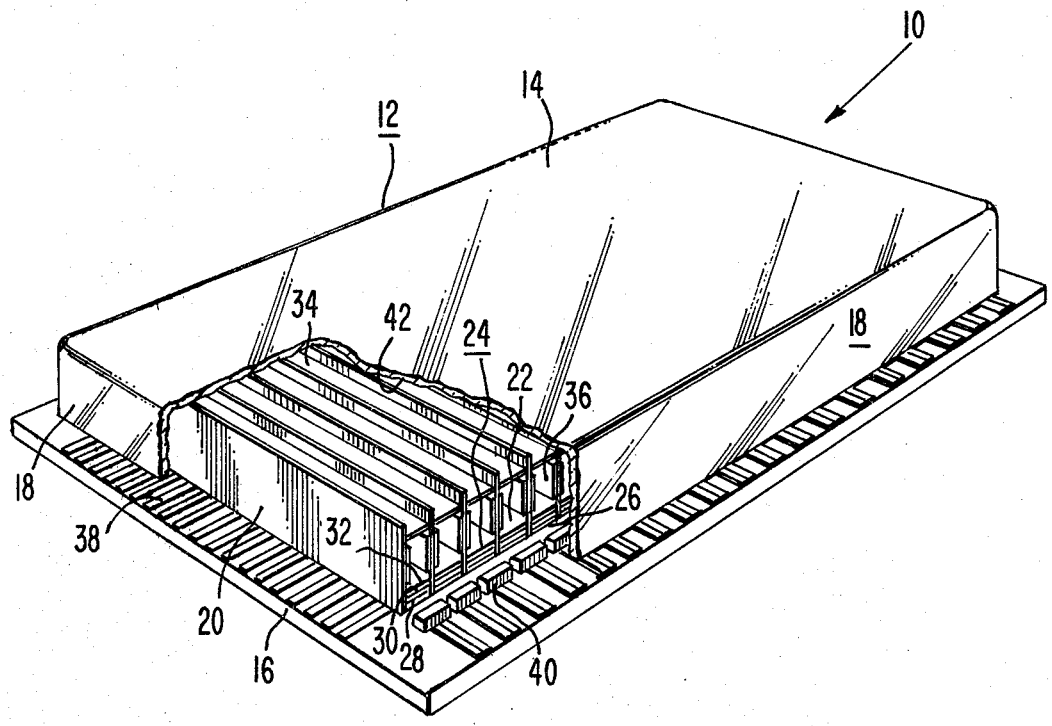
FIG. 1 is a perspective view, partially broken away, of a form of a modular flat panel display which includes the phosphor screen of the present invention.

Referring to FIG. 1, a form of a modular flat panel display device of the present invention is generally designated as 10. The display device 10 is generally of the construction shown and described in the previously referred to application of C. H. Anderson et al, Ser. No. 615,353, now U.S. Pat. No. 4,028,582, issued June 7, 1977. The display device 10 comprises an evacuated envelope 12, typically of glass, having a substantially flat rectangular front wall 14 and a substantially flat rectangular back wall 16 in spaced, parallel relation with the front wall 14. The front wall 14 and back wall 16 are connected by side walls 18. The front wall 14 is dimensioned to provide the size of the viewing screen desired, e.g. 75×100 cm. and is spaced from the back wall 16 about 10 cm. A plurality of spaced, parallel support walls 20 are secured between and are substantially perpendicular to the front wall 14 and back wall 16. The support walls 20 provide the desired internal support for the evacuated envelope 12 against external atmospheric pressure. The support walls 20 also divide the envelope 12 into a plurality of parallel channels 22 which extend along the front wall 14 and back wall 16 between two of the side walls 18 and parallel to the other two side walls.

Along each of the channels 22 adjacent the back wall 16 is an assembly 24 of the type shown and described in the copending applications for Letters Patent of Z. M. Andrevski, Ser. No. 775,300, filed Mar. 7, 1977, entitled "Flat Display Device With Beam Guide" and K. D. Peters, Ser. No. 783,218, filed Mar. 31, 1977, entitled "Guided Beam Flat Display Device With Focusing Guide Assembly Mounting Means". The assembly 24 includes a pair of spaced parallel beam guide plates 26 and 28 which are parallel to the back wall 16 with one of the plates 26 being adjacent to but slightly spaced from the back wall 16; a focusing plate 30 spaced from and parallel to the beam guide plate 28 and an acceleration plate 32 spaced from and parallel to the focusing plate 30. The plates of the assembly 22 have a plurality of aligned openings (not shown) therethrough with the openings in each of the plates being arranged in three rows longitudinally along the channel 22 and a plurality of rows transversely of the channel 22. A shadow mask 34 extends across each of the channels 22 adjacent and parallel to the front wall 14. Each of the shadow masks 34 has a plurality of openings (not shown) therethrough. On each surface of each of the support walls 20 is a scanning electrode 36. The scanning electrodes 36 extend along their respective channels 22 and are spaced from the shadow mask 34 and the assemblies 34. A plurality of spaced, parallel conductors 38 are on the inner surface of the back wall 16 and extend transversely across the channels 22. Each of the conductors 38 extends along a separate transverse row of the openings in the plates of the assemblies 24.

At one end of each of the channels 22 is means for generating electrons and directing the electrons in the form of beams along each of the channels. Three beams of electrons are directed into each of the channels 22 with the beams being directed between the beam guide plates 26 and 28 and with each beam being directed along a separate longitudinal row of the openings in the guide plates. The beam generating and directing means may be individual guns 40 each of which includes three cathodes for generating the three beams and suitable grids for modulating and directing the beams into the channels 22. Alternatively, the beam generating and directing means may be a line cathode (not shown) extending along the ends of all of the channels 22 or individual line cathodes (not shown) extending across the ends of one or more of the channels. The line cathode or cathodes would include electrodes for forming the electrons into beams for modulating the beams and for directing the beams into the channels. One such line cathode is shown and described in the copending application for Letters Patent of R. A. Gange, Ser. No. 784,365, filed Apr. 4, 1977, entitled "Cathode Structure And Method Of Operating The Same".

Figure 2:
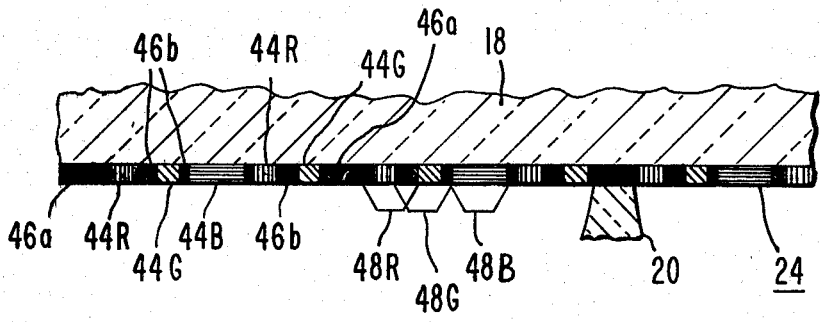
FIG. 2 is a sectional view of a portion of the front wall of the flat panel display showing the phosphor screen of the present invention.

On the inner surface of the front wall 14 is a phosphor screen 42. As shown in FIG. 2, the phosphor screen 42 includes a plurality of bodies 44R, 44G, and 44B of phosphors which emit light of different colors when excited by electrons. The phosphor bodies 44R will emit red light, the phosphor bodies 44G will emit green light and the phosphor bodies 44B will emit blue light. The phosphor bodies 44R, 44G and 44B may be parallel strips of the phosphor material extending parallel to the support walls 20 or may be circular or other shaped bodies extending in rows transversely to or parallel with the support walls 20. The phosphor bodies are arranged in a mosaic of groups with each group containing one of each color emitting phosphor body 44R, 44G and 44B and with the bodies being arranged in the same sequence in each group. However, periodically, preferably in every other group, one of the color phosphor bodies is omitted. The color phosphor body that is omitted is the one that to the eye has the least acuity, which in the case of red, green and blue is the blue phosphor body 44B. The area of the screen 42 which would normally be covered by the blue phosphor body 44B which is omitted is covered instead by a body **46*a* of a nonluminescent black material. The phosphor bodies 44R, 44G and 44B are spaced apart, and the area between the phosphor bodies is covered with a nonluminescent black material 46*b***.

As used hereinafter, the "width" of a body of the screen 42 is the dimension of the body along the screen in the direction transversely across the channels 22. The blue phosphor bodies 44B and the black bodies **46*a* which replace a blue phosphor body are of substantially the same width. As shown in FIG. 2, each of the blue phosphor bodies 44B is of a width substantially equal to the width (i.e. the diameter) of the penumbra of the electron beam 48B which scans the blue phosphor bodies. The red phosphor bodies 44R and the green phosphor bodies 44G are equal in width to each other and to the umbra of their respective electron beams 48R and 48G. As will be explained, this width of the red and green phosphor bodies 44R and 44G is about one-third the width of the region of the blue phosphor bodies 44B. The spacing between the various phosphor bodies is such that the width of the green phosphor body 44G plus the width of the black bodies 46*b* on each side of the green phosphor body is substantially equal to the width of the penumbra of the electron beam 48G which scans the green phosphor bodies. Likewise, the width of the red phosphor bodies 44R and the black bodies on each side thereof are substantially equal to the width of the penumbra of the electron beam 48R** which scans the red phosphor bodies. In addition, the widths of the phosphor bodies and the spacing between adjacent phosphor bodies are such that the center-to-center distances between adjacent bodies of like color are identical. By a phosphor body being substantially as wide as the penumbra or umbra of its respective electron beam it is meant that the phosphor body can be slightly wider or narrower than the respective portion of the beam. Whether a phosphor body is as wide, narrower or wider than the respective portion of its beam depends on the permitted tolerances and the trade-offs in the characteristics of the visual display, i.e. color purity etc. which can be tolerated.

One set of possible width dimensions for the phosphor and black bodies which fit the above requirements are set forth in the following table. The various bodies are listed in sequence from left to right in FIG. 2. The dimensions are for a display of 40 inches (1 meter) linear width and for beams having a penumbra which is about 25 mils (0.64 mm) wide.

| Body | Width | |
|---|---|---|
| | (mils) | (mm) |
| Red | 9.5 | .24 |
| Black | 10 | .25 |
| Green | 9.5 | .24 |
| Black | 4 | .1 |
| Blue | 25.5 | .64 |

-continued

| Body | Width | |
|---|---|---|
| Black | 4 | .1 |
| Red | 9.5 | .24 |
| Black | 10 | .25 |
| Green | 9.5 | .24 |
| Black | 33.5 | .84 |

Since the black bodies 46b on each side of the blue phosphor bodies 44B are so narrow, there is a possibility that the side edges of the red or green electron beams 48R and 48G will excite the blue phosphor as a result of dimensional imperfections. Although this will lead to a partial contamination of the red or green emission by the blue, this should not be visible because of the low luminescence of the blue phosphor and the low electron flux in the extremities of the penumbra of the beam. However, since the blue phosphor body 44B plus adjacent black bodies are slightly wider than the width of the beam there is no danger of the blue beam exciting either the red or green phosphor which would be more objectionable.

As shown in FIG. 2, each of the support walls 20 is positioned at a wider black body 46a so that the support walls are hidden by the black bodies. The width of each channel 22 is such that the portions of the phosphor screen 42 across each channel include a plurality of the groups of the phosphor bodies. Thus, there is not a support wall 20 at each of the wider black bodies 46a. However, the wide black bodies 46a are needed even where there is no support wall in order to achieve a uniform appearance of the phosphor screen.

In the operation of the display device 10, three electron beams are directed along each channel 22 simultaneously between the beam guide plates 26 and 28. The beams are simultaneously selectively deflected toward the front wall at various points along the channels and pass through the openings in the focusing plate 30 and accelerator plate 32. The beams in each channel then pass between the scanning electrodes 36. As described in the previously referred to copending application to C. H. Anderson et al, Ser. No. 615,353 now U.S. Pat. No. 4,028,582, potentials are applied to the scanning electrodes so as to cause the beams to be deflected first toward the support wall at one side of the channel and then toward the support wall at the other side of the channel so that the beams are scanned transversely across their respective channel. As the beams are scanned across the channels, portions of the beams pass through the openings in the shadow mask 34 and impinge on the phosphor screen 42 to provide a line scan on the phosphor screen. The short distance between the beam guide plate 28 and the shadow mask, and the relatively large electron beam diameter in the guides, result in each of the beams having a penumbra which is substantially larger, about twice the size, of the umbra of the beam. The selective deflection of the beam toward the phosphor screen 42 at various points along the channels provide a line-by-line scan of the phosphor screen to achieve the desired visual display.

As the three beams in each channel scan their respective channel, the blue beam 48B will impinge on the blue phosphor bodies 44B and the black bodies 46a, the red beam 48R will impinge upon the red phosphor bodies 44R and the green beam 48G will impinge upon the green phosphor bodies. Since the blue phosphor bodies 44B are of a width substantially equal to the width of the penumbra of the blue beam 48B the entire beam will impinge on the entire width of the blue phosphor body. However, since each of the red phosphor bodies 44R and green phosphor bodies 46G are roughly equal to the umbra of their beams which is about one-third as wide as the penumbra of the respective beams, only one-half of the electrons in each of the red and green beams 48R and 48G will impinge on their respective red phosphor bodies 44R and green phosphor bodies 44G. Thus, although all of the beams are of the same size the light emission from each of the blue phosphor bodies 44B is twice as intense as it would be if the blue phosphor were as wide as the red or green phosphor bodies 44R and 44G. This is desirable to compensate for the blue phosphor bodies which are replaced by black bodies so as to achieve the desired white color balance.

The wider black bodies 46a are desirable to hide the edges of the support walls 20 where they contact the phosphor screen 40. Although every other blue phosphor body is replaced by a black body this is not objectionable to the eye since, as described in the previously referred to application of T. O. Stanley, Ser. No. 806,281 filed June 13, 1977, (1) the blue color has the least acuity to the eye, (2) the black bodies are of substantially the same size as the blue phosphor bodies to achieve a similarity therebetween, and (3) each of the blue phosphor bodies provides a luminous intensity adequate to achieve a white color balance. Thus, there is provided a phosphor screen having the advantages of the phosphor screen described in the application of T. O. Stanley, Ser. No. 806,281 filed June 13, 1977, i.e. being capable of hiding the support walls without interrupting the appearance of the visual display provided by the screen, but providing significantly wider black bodies to hide stronger, i.e. wider or more position tolerant supports while permitting the use of electron beams of the same size to excite the phosphor bodies. Although the screen has been described as being made up of red, green and blue emitting phosphor bodies, it can be made up of any of the well known combinations of color emitting phosphor bodies with the color which has the least acuity to the eye being the one that is periodically replaced by the black material body.

I claim:

1. In a flat display device which includes an evacuated envelope having a plurality of spaced support walls extending to a phosphor screen bearing wall and forming channels therebetween, means for generating beams of electrons and means for directing at least one beam in each of said channels across said phosphor screen, the improvement comprising, said phosphor screen including repetitive groups of bodies of different color emitting phosphors in spaced apart relation across the screen a selected one of the color emitting phosphor bodies in some of said groups being replaced by a body of a non-luminous material, each of the one color emitting bodies which is remaining being of a width substantially equal to the width of the electron beam which impinges on the one color emitting body, each of the other color emitting phosphor bodies being of a width less than the width of the electron beam which impinges on them and the combined width of each of the other color emitting bodies and the spaces on each side of each of said other color emitting bodies being substantially equal to the width of the electron beam which impinges on said bodies.

2. A flat display device in accordance with claim 1 in which the color emitting phosphors are red, green and blue and the color which is periodically replaced by the nonluminous material is the blue emitting phosphor.

3. A flat display device in accordance with claim 2 in which the nonluminous material is a black material.

4. A flat display device in accordance with claim 3 in which the spaces between the color emitting phosphor bodies are covered with a black material.

5. A flat display device in accordance with claim 4 in which the blue emitting phosphor body in every other group is replaced with a black material.

6. A flat display device in accordance with claim 5 in which each of the red emitting phosphor bodies and each of the green emitting phosphor bodies is of a width approximately one-third the width of the blue emitting phosphor bodies.

7. A flat display device in accordance with claim 6 in which the width of the color emitting phosphor bodies and the black material are such that the center-to-center spacing between adjacent bodies of like color are substantially equal.

8. A flat display device in accordance with claim 7 in which each of the support walls is positioned at a separate one of the black material bodies which replaces a blue emitting phosphor body.

9. A flat display device in accordance with claim 8 in which there are three beams in each channel with each beam scanning a different color emitting phosphor body and the portions of the beams which impinge on the phosphor screen are substantially the same width.

10. A flat display device in accordance with claim 9 in which the width of each blue emitting phosphor body is substantially equal to the penumbra of the beam which impinges on the blue emitting phosphor bodies and the width of each of the red and green emitting phosphor bodies is substantially equal to the umbra of the beam which impinges on said respective phosphor bodies.

11. A flat display device in accordance with claim 10 in which the width of each of the red and green emitting phosphor bodies, plus the width of the black bodies on each side of said red and green emitting phosphor bodies is substantially equal to the penumbra of the beam which impinges on said respective phosphor bodies.

* * * * *